United States Patent [19]

Aldridge et al.

[11] Patent Number: 4,762,607

[45] Date of Patent: Aug. 9, 1988

[54] HYDROCONVERSION PROCESS WITH COMBINED TEMPERATURE AND FEED STAGING

[75] Inventors: Clyde L. Aldridge; William E. Lewis; Roby Bearden, Jr.; Francis X. Mayer, all of Baton Rouge, La.

[73] Assignee: Exxon Research and Engineering Company, Florham Park, N.J.

[21] Appl. No.: 37,511

[22] Filed: Apr. 13, 1987

Related U.S. Application Data

[63] Continuation-in-part of Ser. No. 857,358, Apr. 30, 1986.

[51] Int. Cl.[4] ..... C10G 65/10

[52] U.S. Cl. ..... 208/59; 208/49; 208/78; 208/80; 208/108; 208/112

[58] Field of Search ..... 208/57, 59, 58, 78, 208/80, 108, 112, 49

[56] References Cited

U.S. PATENT DOCUMENTS

| | | | |
|---|---|---|---|
| 3,260,663 | 7/1966 | Inwood et al. | 208/80 |
| 3,265,610 | 8/1966 | Lavergne et al. | 208/80 |
| 3,267,021 | 8/1966 | Gould | 208/78 |
| 3,607,723 | 9/1971 | Peck et al. | 208/59 |
| 4,059,502 | 11/1977 | James | 208/157 |
| 4,082,647 | 4/1978 | Hutchings et al. | 208/80 |
| 4,133,842 | 1/1979 | Anderson | 208/49 |
| 4,151,070 | 4/1979 | Allan et al. | 208/59 |
| 4,502,946 | 3/1985 | Pronk | 208/152 |

*Primary Examiner*—Anthony McFarlane
*Attorney, Agent, or Firm*—Henry E. Naylor

[57] ABSTRACT

A slurry catalytic hydroconversion process comprising at least two hydroconversion zones is provided in which the heavy hydrocarbonaceous fresh oil feed is added to more than one hydroconversion zone. Additional portions of catalysts or catalyst precursors are also added to the first hydroconversion zone and to additional hydroconversion zones wherein said additional hydroconversion zones are maintained at a temperature of at least 10° F. higher than an immediate preceding hydroconversion zone.

12 Claims, 1 Drawing Sheet

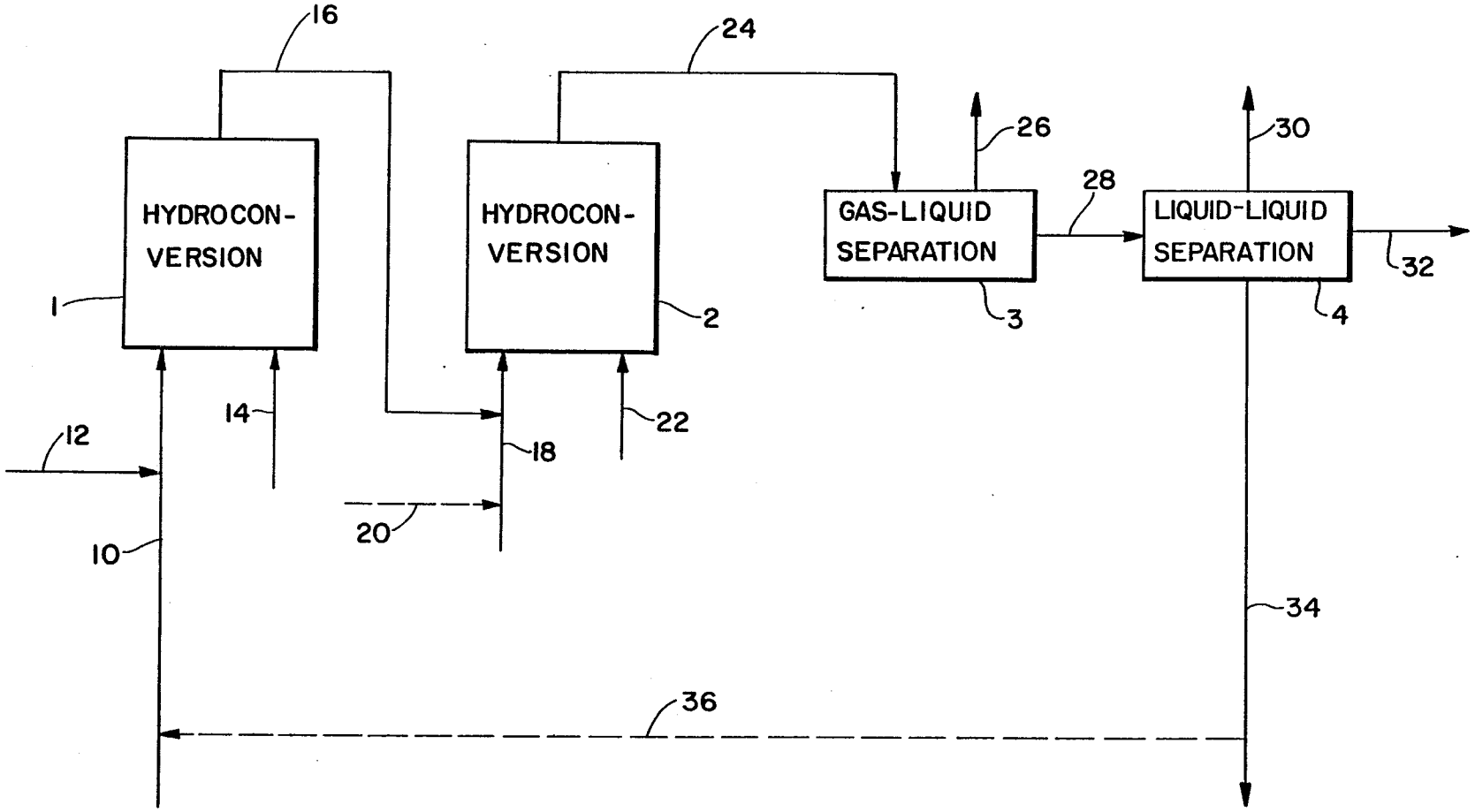
HYDROCON-
VERSION
HYDROCON-
VERSION
GAS-LIQUID
SEPARATION
LIQUID-LIQUID
SEPARATION
1
2
3
4
10
12
14
16
18
20
22
24
26
28
30
32
34
36

HYDROCONVERSION PROCESS WITH COMBINED TEMPERATURE AND FEED STAGING

CROSS REFERENCE TO RELATED APPLICATIONS

This application is a continuation-in-part of U.S. Ser. No. 857,358, filed Apr. 30, 1986.

BACKGROUND OF THE INVENTION

1. Field of the Invention

The present invention relates to a slurry hydroconversion process conducted in two hydroconversion stages wherein the temperature of the second stage is at least 10° F. higher than the first stage.

2. Description of Information Disclosures

Slurry hydroconversion processes in which a catalyst is dispersed in a hydrocarbonaceous oil to convert the oil in the presence of hydrogen are known.

U.S. Pat. No. 4,134,825 discloses a catalytic slurry hydroconversion process using a catalyst produced in the oil feed from a catalyst precursor.

U.S. Pat. No. 4,151,070 discloses a staged hydroconversion process in which the liquid effluent of the first hydroconversion zone is separated into fractions and in which the heavy fraction is passed to a second hydroconversion zone. The first hydroconversion zone is operated at a lower temperature than the second hydroconversion zone.

U.S. Pat. No. 4,606,809 also discloses a staged hydroconversion process wherein the temperature of a second stage is higher than that of a first stage, except product is not removed between stages.

The exothermic nature of hydroconversion of heavy hydrocarbonaceous oils to lower boiling products is disclosed in U.S. Pat. No. 3,622,497 wherein the effluent from the reaction chamber is substantially higher in temperature than the inlet temperature of the chamber. The temperature gradient from inlet to outlet is maintained at a temperature less than about 450° C.

The term "hydroconversion" is used herein to designate a process conducted in the presence of hydrogen in which at least a portion of the heavy constituents of the hydrocarbonaceous oil is converted to lower boiling hydrocarbon products while it may simultaneously reduce the concentration of nitrogenous compounds, sulfur compounds, and metallic contaminants.

It has now been found that adding the fresh oil feed to more than one hydroconversion zone of a plurality of serially connected hydroconversion zones wherein each subsequent zone is maintained at a temperature of at least 10° F. higher than the preceeding zone, will provide advantages, such as a decrease in hydrogen preheat and a decrease in overall catalyst requirement. Furthermore, the use of more than one hydroconversion zones, as well as the introduction of fresh feed into more than one hydroconversion zones contributes to the control of the exothermic reaction taking place in said zones.

SUMMARY OF THE INVENTION

In accordance with the invention, there is provided, in a slurry hydroconversion process comprising at least two zones, a process which comprises the steps of: (a) adding a catalyst or catalyst precursor to a chargestock comprising a first portion of a fresh heavy hydrocarbonaceous oil chargestock to form a mixture; (b) reacting the resulting mixture with a hydrogen-containing gas in a first hydroconversion zone at first hydroconversion conditions to produce a first hydroconverted oil; (c) introducing at least a portion of the effluent of said first hydroconversion zone, including at least a portion of said first hydroconverted oil, into a second hydroconversion zone at second hydroconversion conditions such that the temperature of said second zone is at least 10° F. higher than said first zone, to react with a hydrogen-containing gas and produce a second hydroconverted oil, the improvement which comprises: introducing a second portion of said fresh heavy hydrocarbonaceous oil to said second hydroconversion zone.

BRIEF DESCRIPTION OF THE DRAWING

The FIGURE is a schematic flow plan of one embodiment of the invention.

DESCRIPTION OF THE PREFERRED EMBODIMENT

Referring to the figure, a heavy hydrocarbonaceous oil feed carried in line 10 in admixture with the catalyst or catalyst precursor introduced into the oil by line 12 is passed into hydroconversion zone 1 which is the first of a series of related hydroconversion zones.

The Heavy Hydrocarbon Oil Feed

Suitable hydrocarbonaceous oil feeds include heavy mineral oils, whole or topped crude oils, including heavy crude oils; asphaltenes; hydrocarbonaceous oil boiling above 650° F. (343.33° C.); petroleum atmospheric residuum (boiling above 650° F.; petroleum vacuum residua boiling above 1050° F. (565.56° C.); tars; bitumen; tar sand oils; shale oils; liquid products derived from coal liquefaction processes, including coal liquefaction bottoms, and mixtures thereof. The process is particularly suitable to convert heavy crude oils and residual oils containing materials boiling above 1050° F. and which generally contain a high content of metallic contaminants (nickel, iron, vanadium) usually present in the form of organometallic contaminants, a high content of sulfur compounds, nitrogenous compounds and a high Conradson carbon residue. The metallic content of such oils may range up to 2000 wppm or more and the sulfur content may range up to 8 wt. % or more. Preferably, the feed is a heavy hydrocarbon oil comprising materials boiling above 1050° F., more preferably having at least about 10 wt. % materials boiling above 1050° F. To any of these feeds may be added coal.

All boiling points referred to herein are equivalent atmospheric pressure boiling points unless otherwise specified. Whenever reference is made herein to fresh feed, it is intended that it is not as recycle stream; however, the fresh feed may be a cracked oil derived from other processes.

The Hydroconversion Catalyst

The hydroconversion catalyst introduced via line 12 and optionally via line 20 into the oil feed to form a dispersion of the catalyst in the oil may be any suitable hydroconversion catalyst or catalyst precursor suitable for use in slurry processes (i.e., a process in which the catalyst is admixed with the oil). The catalyst may comprise a Group VB, Group VIB or Group VIII metal, metal oxide or metal sulfide and mixtures thereof and may be a supported or unsupported catalyst. Instead of introducing a preformed catalyst via line 12, a catalyst precursor may be used such as an oil soluble metal compound or a thermally decomposable metal compound such as the catalyst precursors described in U.S. Pat. No. 4,134,825, the teachings of which are hereby incorporated by reference. Catalysts comprising cobalt, molybdenum, nickel, tungsten, iron and mixtures thereof on an alumina-containing support or on solid carbonaceous supports, such as coal or coke, are also suitable.

A hydrogen-containing gas is introduced into hydroconversion zone 1 by line 14. The hydrogen-containing gas may be pure hydrogen, but will generally be an impure hydrogen stream such as a hydrogen-containing gas derived from a process, e.g., reformer offgas. Although the figure shows the hydrogen being introduced directly into the hydroconversion zone, it is to be understood that the hydrogen-containing gas of line 14 could be introduced into oil feed line 10 and passed into the hydroconversion zone in admixture with the oil. In hydroconversion zone 1, the oil feed is subjected to hydroconversion conditions to convert at least a portion of the oil to lower boiling hydrocarbon products.

Slurry Hydroconversion Conditions

Suitable operating conditions for all the slurry hydroconversion zones of the process are summarized in Table I.

TABLE I

| Conditions for all Reactors | Broad Range | Preferred Range |
|---|---|---|
| Temperature, °F. | 780-900 | 800-870 |
| $H_2$ partial pressure, psig | 50-5,000 | 100-2,500 |
| $H_2$-containing gas rate, SCF/bbl | 2000-30,000 | 4,000-20,000 |

The hydroconversion zone effluent comprising a normally gaseous phase, a normally liquid phase and catalyst particles is removed from hydroconversion zone 1 by line 16. If desired, at least a portion of the gaseous phase may be removed from the effluent. The effluent of hydroconversion zone 1 comprising the normally liquid phase is passed into hydroconversion zone 2 which is the second hydroconversion zone into which an additional portion of fresh oil chargestock is introduced by line 18. This second hydroconversion zone is maintained at a temperature of at least 10° F. preferably, at least 20° F., higher than that of the first hydroconversion zone 1. The fresh oil is a portion of the same oil that was introduced by line 10 into hydroconversion zone 1. An additional portion of catalyst or catalyst precursor may be introduced into fresh feed line 18 via line 20. An additional hydrogen-containing gas may be introduced into hydroconversion zone 2. If the gas phase had been removed from the effluent of the first hydroconversion zone, then introduction of the required hydrogen would be made via line 22. As previously described, the hydrogen of line 22 may be introduced into fresh feed line 18 or it may be introduced directly into hydroconversion zone 2. The effluent of hydroconversion zone 2 is removed by line 24 and, if desired, may be passed with or without separation of gas phase from the liquid into additional hydroconversion zones (not shown) into which additional portions of fresh feed may be introduced. It should be noted that it is not required that the additional portion of fresh feed be introduced into a specific second hydroconversion zone. The additional portion of fresh feed may be introduced into any one of a series of hydroconversion zones or into each of the hydroconversion zones of a plurality of hydroconversion zones in series. The percentages of fresh feed introduced into the first hydroconversion zone, and to the subsequent hydroconversion zones are as follows:

| % Fresh Feed to First Hydroconversion Zone | | % Fresh Feed to Subsequent Hydroconversion Zones | |
|---|---|---|---|
| Broad | Preferred | Broad | Preferred |
| 25-95 wt. % | 50-90 wt. % | 5-75 wt. % | 10-50 wt. % |

The actual conditions may be the same in the first, second or any subsequent hydroconversion zone, or may be different within the given ranges.

The effluent of hydroconversion zone 2, which comprises a normally gaseous phase, a normally liquid phase (e.g., hydroconverted oil) and catalyst particles, is passed by line 24 into a gas-liquid separation zone 3. The gaseous phase comprising hydrogen is removed by line 26. If desired, the gas may be recycled to any of the hydroconversion zones with or without additional cleanup.

The normally liquid phase line 28, which comprises hydroconverted hydrocarbonaceous oil and catalytic solids is passed to separation zone 4 for fractionation by conventional means such as distillation, into various fractions, such as light boiling, medium boiling and heavy bottoms fractions containing the catalytic solids. The light fraction is removed by line 30. The medium boiling fraction is removed by line 32. The heavy bottoms fraction is removed by line 34. If desired, at least a portion of the bottoms fraction may be recycled to hydroconversion zone 1 by line 36. Alternatively, if desired, the bottoms fraction may be recycled to hydroconversion zones 1 or 2. When the process comprises more than 2 hydroconversion zones, the heavy bottoms portion separated from the effluent of the last of these hydroconversion zones may be recycled to at least one of the hydroconversion zones.

The following examples are presented to illustrate the invention.

EXAMPLE 1

Seventy percent of a topped Cold Lake feed (780° F.+, containing 74.08 wt. % of 975° F.+material) was hydroconverted in a first stage at 846° F. and 1923 psi $H_2$ pressure at a feed rate of 0.59 V/V/Hr. (nominal holding time of 1.7 hr. excluding vaporization effects). Molybdenum catalyst was provided in the amount of 225 wppm on feed by adding a concentrate of phosphomolybdic acid in Cold Lake crude. After this first stage, gaseous materials and volatile hydrocarbons were removed to yield 9.76 wt. % of residual material containing the catalyst.

The remaining 30% of the fresh feed was then blended with the effluent from the first stage and the mixture passed to a second hydroconversion stage maintained at 840° F. and 2000 psig with hydrogen for three hours (0.33 V/V/Hr.). After the two-stage treatment the conversion of material boiling above 975° F. in the total fresh feed to oil boiling below 975° F. plus gas was 90.3 wt. %, and toluene insolubles produced amounted to 2.1 wt. % on total fresh feed.

EXAMPLE 2

Cold Lake vacuum residuum was hydroconverted in a continuous pilot plant containing two tubular reactors of equal size at a total pressure of 2090 psig and at a space velocity adjusted to give 94.0% conversion of the 1050+° F. material to 1050−° F. products. The temperature of the first reactor was maintained at 825° F. and that of the second reactor at 835° F. Total hydrogen treat gas amounted to 9100 SCF/bbl of feed, two-thirds of which was added to the first reactor and one-third to the second reactor.

Phosphomolybdic acid dispersed as a concentrate in Cold Lake crude (0.5 wt. % Mo) was added to the feed in an amount to provide 314 wppm Mo on feed, which was an amount just sufficient to provide adequate hydrogenation catalysis and to substantially prevent formation of any significant detectable amount of mesophase carbon. Eleven weight percent of bottoms (based on fresh feed) from this conversion was recycled with the feed. Yields of products as wt. % on fresh feed are as follows: $C_1$–$C_4$, 12.2%, Naphtha ($C_5$–350° F.), 18.0%, Distillate (350°–650° F.), 35.7%; Vacuum Gas Oil (650°–1050° F.), 26.1%. The hydrogen consumption was 2040 SCF/bbl of fresh feed.

EXAMPLE 3

An experiment was carried out according to Example 2 with conditions identical in all respects except that the temperature of the first reactor was maintained at 817° F. and that of the second reactor at 838° F. Conversion of 1050+° F. material to 1050−° F. products was 93.6%. In this experiment it was possible to lower the molybdenum catalyst concentration of 250 wppm on fresh feed while providing adequate hydrogenation catalysis and substantially preventing formation of any significant detectable amount of mesophase carbon. Yields of products as wt.% on fresh feed were as follows: $C_1$–$C_4$, 12.1%, Naphtha ($C_5$–350° F.), 18.0%; Distillate (350°–650° F.), 34.7%; Vacuum Gas Oil (650°–1050° F.), 27.0%. The hydrogen consumption was 2030 SCF/bbl of fresh feed.

Results from Examples 2 and 3 are tabulated for comparison:

TABLE II

| | Example 2[a] | Example 3[b] |
|---|---|---|
| 1050+ °F. Conversion | 94.0 | 93.6 |
| Yields, wt. % on Feed | | |
| $C_1$–$C_4$ | 12.2 | 12.1 |
| Naphtha ($C_3$–350° F.) | 18.0 | 18.0 |
| Distillate (350–650° F.) | 35.7 | 34.7 |
| Vacuum Gas Oil (650–1050° F.) | 26.1 | 27.0 |
| Hydrogen Consumption, SCF/bbl | 2040 | 2030 |
| Mo Catalyst Requirement, wppm | 314 | 250 |

[a]Average of three analytical balance periods.
[b]Average of six analytical balance periods.

EXAMPLE 4

Experiments are run according to the procedure of Example 3 above except that the conversion of 1050+° F. material to 1050−°F. products is controlled in all cases to 95%. The amount of temperature staging and the amount of feed going to the second of the two stages, which varies as shown in Table III below, will have a synegetic reduction in the amount of catalyst required to prevent formation of any detectable amount of mesaphase carbon.

TABLE III

| Example | Reactor 1 % Fresh Feed | Reactor 1 °F. | Reactor 2 % Fresh Feed | Reactor 2 °F. | Catalyst Requirement, Mo on Fresh Feed |
|---|---|---|---|---|---|
| A | 100 | 830 | 0 | 830 | a |
| B | 100 | 820 | 0 | 840 | b |
| C | 70 | 830 | 30 | 830 | c |
| D | 70 | 820 | 30 | 840 | d |

where a, b, c, and d are numeric values such that a > b > c > d.

What is claimed is:

1. In a slurry hydroconversion process, for converting a heavy hydrocarbonaceous oil to lower boiling products, which process takes place in at least two zones, said process comprising the steps of:

(a) adding a catalyst or a catalyst precursor to a chargestock comprising a first portion of fresh heavy hydrocarbonaceous oil to form a mixture, which hydrocarbonaceous oil contains materials boiling above about 1050° F.;

(b) reacting the resulting mixture with a hydrogen-containing gas in a first hydroconversion zone at first hydroconversion conditions comprising a temperature range from about 780° F. to about 900° F., and a hydrogen partial pressure from about 50 to about 5,000 psig, to produce a first hydroconverted oil which has a lower boiling range than the hydrocarbonaceous chargestock;

(c) introducing at least a portion of the effluent of said first hydroconversion zone, including at least a portion of said first hydroconverted oil into a second hydroconversion zone at second hydroconversion conditions comprising the range of conditions of said first hydroconversion zone but with the proviso that the temperature of the second hydroconversion zone be at least about 10° F. higher than said first hydroconversion zone, to react with a hydrogen-containing gas and produce a second hydroconverted oil which has a boiling range lower than said first hydroconverted oil, the improvement which comprises:

(d) introducing a second portion of said fresh heavy hydrocarbonaceous oil to said second hydroconversion zone.

2. The process of claim 1 wherein said slurry hydroconversion process is conducted in more than two slurry hydroconversion zones in series and wherein at least a portion of said fresh hydrocarbonaceous oil is introduced into said first hydroconversion zone and into at least one additional hydroconversion zone.

3. The process of claim 1 wherein said slurry hydroconversion process is conducted in more than two slurry hydroconversion zones in series and wherein the temperature of each suceeding hydroconversion zone is at a temperature at least about 20° F. higher than the immediately preceding zone.

4. The process of claim 1 wherein said slurry hydroconversion process is conducted in a plurality of slurry hydroconversion zones and wherein a heavy bottoms portion is separated from the effluent of the last of said hydroconversion zones and, thereafter, the separated bottoms portion is recycled to at least one of said hydroconversion zones.

5. The process of claim 3 wherein said slurry hydroconversion process is conducted in a plurality of slurry hydroconversion zones and wherein a heavy bottoms portion is separated from the effluent of the last of said hydroconversion zones and, thereafter, the separated bottoms portion is recycled to at least one of said hydroconversion zones.

6. The process of claim 1 wherein an additional portion of said catalyst or catalyst precursor is introduced into at least one of said hydroconversion zones other than said first hydroconversion zone.

7. The process of claim 3 wherein an additional portion of said catalyst or catalyst precursor is introduced into at least one of said hydroconversion zones other than said first hydroconversion zone.

8. The process of claim 1 wherein each of said first and said second hydroconversion conditions include a temperature ranging from about 800° to 900° F. and a hydrogen partial pressure ranging from about 50 to 5000 psig.

9. The process of claim 8 wherein the temperature of said second hydroconversion zone is at least 20° F. higher than said first hydroconversion zones.

10. The process of claim 1 wherein said hydroconversion catalyst precursor is an oil soluble metal compound or a thermally decomposable metal compound.

11. The process of claim 1 wherein said first portion of fresh heavy oil is from 25 to 90 weight percent of the total chargestock of said process.

12. The process of claim 1 wherein said first portion of fresh hydrocarbonaceous oil comprises at least about 10 weight percent materials boiling above 1050° F.

* * * * *